US011905664B2

(12) United States Patent
Lee et al.

(10) Patent No.: US 11,905,664 B2
(45) Date of Patent: Feb. 20, 2024

(54) HOT-PRESS GAS GRAFTING HYDROPHOBIZATION APPARATUS, AND ECO-FRIENDLY OIL-ABSORBING LOW-WEIGHT PAPER MANUFACTURED USING SAME

(71) Applicants: KNU-Industry Cooperation Foundation, Gangwon-do (KR); Daehan Paper Co., Ltd., Chungcheongbuk-do (KR); Taekyung Polymer Co., Ltd., Gyeonggi-do (KR)

(72) Inventors: Myoung Ku Lee, Gangwon-do (KR); Jeong Yong Ryu, Gangwon-do (KR); Kwang Seob Lee, Gangwon-do (KR); Jae Hoon Lee, Gangwon-do (KR); Han Je Cho, Seoul (KR); Hyeok Jun Kwon, Gyeonggi-do (KR); David Guerin, Grenoble (FR); Philippe Martinez, Grenoble (FR); Kyung Wha Choi, Gangwon-do (KR)

(73) Assignees: KNU-Industry Cooperation Foundation, Gangwon-do (KR); Daehan Paper Co., Ltd., Chungcheongbuk-do (KR); Taekyung Polymer Co., Ltd., Gyeonggi-do (KR)

( * ) Notice: Subject to any disclaimer, the term of this patent is extended or adjusted under 35 U.S.C. 154(b) by 471 days.

(21) Appl. No.: 17/282,814

(22) PCT Filed: Sep. 17, 2019

(86) PCT No.: PCT/KR2019/011984
§ 371 (c)(1),
(2) Date: Apr. 5, 2021

(87) PCT Pub. No.: WO2020/071659
PCT Pub. Date: Apr. 9, 2020

(65) Prior Publication Data

US 2021/0381171 A1 Dec. 9, 2021

(30) Foreign Application Priority Data

Oct. 4, 2018 (KR) ..... 10-2018-0118183

(51) Int. Cl.
*D21H 23/56* (2006.01)
*D21H 17/36* (2006.01)
(Continued)

(52) U.S. Cl.
CPC ..... *D21H 23/56* (2013.01); *D21H 17/36* (2013.01); *D21H 21/16* (2013.01); *D21H 23/70* (2013.01); *D21H 25/06* (2013.01); *D21H 27/002* (2013.01)

(58) Field of Classification Search
CPC ..... D21H 23/56; D21H 17/36; D21H 21/16; D21H 23/70; D21H 25/06; D21H 27/002;
(Continued)

(56) References Cited

U.S. PATENT DOCUMENTS 6,342,268 B1 * 1/2002 Samain ..... B01J 20/3248 427/255.6
8,637,119 B2 * 1/2014 Stinga ..... B05D 7/52 427/430.1
(Continued)

FOREIGN PATENT DOCUMENTS

EP 3859083 A4 * 7/2022 ..... D21H 17/11
FR 2967363 A1 * 5/2012 ..... B05C 9/12
(Continued)

OTHER PUBLICATIONS

International Search Report from corresponding PCT Application No. PCT/KR2019/011984, dated Dec. 17, 2019.
(Continued)

*Primary Examiner* — Jose A Fortuna
(74) *Attorney, Agent, or Firm* — Harness, Dickey & Pierce, P.L.C.

(57) ABSTRACT

The present invention relates to a press-heating gas grafting hydrophobization apparatus, and a hot water-resistant paper
(Continued)

and an oil-absorbing paper manufactured using the press-heating gas grafting hydrophobization apparatus. In the press-heating gas grafting hydrophobization apparatus according to the present invention, since a non-air-permeable dryer belt is provided surrounding and pressing a drying roller to prevent dissipation from a base material of a fatty acid chloride vaporized by the drying roller, the press-heating gas grafting hydrophobization apparatus has an advantage of improving efficiency of a gas grafting reaction. Therefore, by using the press-heating gas grafting hydrophobization apparatus according to the present invention, the reaction amount of fatty acid chloride per unit area can be remarkably improved.

3 Claims, 1 Drawing Sheet

(51) Int. Cl.

| | |
|---|---|
| ***D21H 21/16*** | (2006.01) |
| ***D21H 25/06*** | (2006.01) |
| ***D21H 27/00*** | (2006.01) |
| ***D21H 23/70*** | (2006.01) |

(58) Field of Classification Search
CPC ..... D21H 17/11; D21H 17/14; D21H 19/08; D21H 21/14; D21H 23/44; D21H 23/50; D21H 27/00; D21H 21/34
See application file for complete search history.

(56) References Cited

U.S. PATENT DOCUMENTS

| | | | | |
|---|---|---|---|---|
| 2013/0236647 | A1* | 9/2013 | Samain | B05D 3/007 118/63 |
| 2014/0113080 | A1* | 4/2014 | Stinga | D21H 19/20 427/389.9 |
| 2021/0381171 | A1* | 12/2021 | Lee | D21H 21/14 |

FOREIGN PATENT DOCUMENTS

| | | | | |
|---|---|---|---|---|
| FR | WO-9908784 | A1 * | 5/2012 | B05C 9/12 |
| JP | 2005-060555 | A | 3/2005 | |
| JP | 2017-137597 | A | 8/2017 | |
| JP | 2022510726 | A * | 1/2022 | D21H 21/16 |
| JP | 7273166 | B2 * | 5/2023 | D21H 17/11 |
| KR | 10-2016-0141920 | A | 12/2016 | |
| KR | 10-1752340 | B1 | 6/2017 | |
| KR | 101938616 | B1 * | 4/2019 | B01J 2/30 |
| KR | 10-1974895 | B1 | 5/2019 | |
| WO | 101974895 | B1 * | 4/2020 | D21H 17/11 |
| WO | WO-2020071659 | A1 * | 4/2020 | D21H 17/11 |

OTHER PUBLICATIONS

Office Action from corresponding Korean Patent Application No. 10-2018-0118183, dated Jan. 9, 2019.
Office Action from corresponding Korean Patent Application No. 10-2018-0118183, dated Mar. 22, 2019.

* cited by examiner

PRIOR ART

HOT-PRESS GAS GRAFTING HYDROPHOBIZATION APPARATUS, AND ECO-FRIENDLY OIL-ABSORBING LOW-WEIGHT PAPER MANUFACTURED USING SAME

CROSS-REFERENCE TO RELATED APPLICATIONS

This application is a national phase application of PCT Application No. PCT/KR2019/011984, filed on 17 Sep. 2019, which claims benefit of Korean Patent Application No. 10-2018-0118183, filed 4 Oct. 2018. The entire disclosure of the applications identified in this paragraph are incorporated herein by references.

TECHNICAL FIELD

The present invention relates to a press-heating gas grafting hydrophobization apparatus, and a hot water-resistant paper and an oil-absorbing paper manufactured by using the press-heating gas grafting hydrophobization apparatus.

BACKGROUND ART

Current people conveniently use and throw away numerous disposable plastic products from the time of waking up until bedtime.

Products made of plastic such as easily used disposable cups, plastic bottles, straws, various packaging materials, and plastic bags are not rotten, so that the plastic products are not be decomposed to be accumulated, and thus, the plastic products have a serious adverse effect on the global environment.

Consistent with the name 'disposable', most disposable plastic products stay in our hands for only a few minutes, but the plastic products have not been biodegraded for hundreds of years and have remained in the ecosystem to become food for marine animals.

Plastic waste that flows into the sea is finely broken to become food for marine creatures, and thus, the plastic waste is in a vicious cycle of returning back to humans along the food chain.

Every year, 8 million tons of plastic waste flow into the sea, threatening the health of the planet and the human beings.

Unlike plastic products, paper is made of natural wood fibers that can be recycled. The paper is biodegradable and easy to recycle by disintegrating in water, but the paper has a disadvantage of lacking the ability to block water, oil, gas, and the like.

Recently, composite materials having enhanced water resistance formed by coating a plastic film on paper have been widely used.

As a representative example, there is a PE-laminated composite material that has enhanced water resistance formed by laminating a polyethylene (PE) film on paper.

The PE-laminated composite material has excellent water resistance and has an advantage of maintaining the water resistance even when the composite material comes into contact with high-temperature contents. Therefore, the PE-laminated composite material has been widely used in food packaging paper, paper cups, paper lunch boxes, paper plates for confectionery, and the like.

However, PE used for the PE-laminated composite material is also a type of plastic and is not soluble in water, so that, the PE is hard to recycle, and the PE is not biodegraded, which causes serious marine pollution.

Accordingly, a technology that enhances environmental friendliness by developing and applying a new paper surface treatment technology that replaces the method of enhancing water resistance by coating the plastic film in the related art has been required for the entire processes from the production process to the regeneration treatment.

In particular, if plastic is not used and only biodegradable, eco-friendly paper is used to block water, oil, gas, and the like, it is expected that resources and the environment can be protected from plastic pollution.

SUMMARY

Technical Problem

In France, Daniel Samain and others have developed new technology and apparatus for hydrophobizing a hydrophilic cellulose surface by using hydrophobization treatment of cellulose using a gas grafting reaction, and these technology and apparatus are filled as patent applications, and some thereof are granted patents (U.S. Pat. Nos. 6,342,268, 8,637,119, EP 2,231,401, US 2013-0199409, US 2014-0113080, and US 2013-0236647).

In this technology, also called "Chromogenic Technology", fatty acid ester is formed by reacting gaseous fatty acid chloride on a hydrophilic surface containing a hydroxyl group, as expressed in Chemical Reaction Formula 1 below, and thus, the hydrophilic surface is hydrophobized.

$$\text{S—OH+RCOCL} \longleftrightarrow \text{S—O—CO—R+HCL (R is alkyl or alkenyl)} \quad \text{[Chemical Formula 1]}$$

In the related art, in a gas grafting apparatus (US 2013-0236647), reaction heat is transferred from a drum dryer to a base material, so that a hydroxyl group of the base material and a vaporized fatty acid chloride react each other effectively. However, in the related art, in a gas grafting apparatus (US 2013-0236647), since a drum dryer (drying roller) and the base material are in contact with each other only depending on the tension of the base material, there is a problem that the reaction heat transferred from the drum dryer to the base material is insufficient. In particular, in a case where, like paper, the base material is deformed by heat or shrinks and expands according to a change in moisture content, there is a problem that the grafting reaction shows non-uniformity since the base material is not adhered to the drying roller.

In the case of the low-basis-weight paper, the above-described problems become even greater. If the reaction heat is not sufficient, the efficiency of the gas grafting reaction decreases, and as a result, the water resistance of the base material is lowered.

In addition, in the related art, in a gas grafting apparatus (US 2013-0236647), since the drying roller and the base material are in contact with each other only depending on the tension of the base material, the vaporized fatty acid chloride is lost before the gas grafting reaction, so that there is a problem that the hydrophobization efficiency decreases.

Due to these technical limitations, the gas grafting treatment for low-basis-weight, low-density paper cannot be achieved with the gas grafting apparatus (US 2013-0236647) in the related art.

In order to overcome this problem, methods of preventing the loss of the vaporized fatty acid chloride by disposing a plurality of papers ply-by-ply have been used, but these methods cannot guarantee a uniform result of the gas grafting reaction for each of the papers disposed ply-by-ply.

In addition, there is a problem in that it is impossible to manufacture a product configured with a single ply unless the multiple layers of paper are detached one by one again.

Accordingly, in order to solve the above-described problems, an object of the present invention is to provide a press-heating gas grafting hydrophobization apparatus and a hot water-resistant paper and a low-basis-weight eco-friendly oil-absorbing paper manufactured by using the press-heating gas grafting hydrophobization apparatus.

Technical Solution

In order to solve the above-described problems, the present invention includes an unwinder unit 10 for continuously supplying a base material; a drying unit 20 for heating a surface of the base material exposed to a hydroxyl group; a coating roller 30 for coating a gas grafting reagent on the surface of the base material exposed to the hydroxyl group; a drying roller 40 for vaporizing the coated grafting reagent and heating so that a grafting reaction occurs on the surface of the base material, the drying roller including touch rolls 41 and 42 for adhering the surface of the base material on which the grafting reagent is coated toward the surface of the belt; a dryer belt (50) for surrounding the drying roller (40) and adhering the surface of the base material on which the grafting reagent is coated toward a surface of the drying roller; a ventilator 60 for removing hydrogen chloride generated during a gas grafting reaction; an air knife nozzle 70 for removing a residual gas grafting reagent from the surface of the base material; and a rewinder unit 80 for rewinding the base material subjected to the gas grafting reaction.

The dryer belt 50 is non-air-permeable, prevents dissipation of the vaporized grafting reagent, and presses the base material to the surface of the drying roller 40 at a pressure of 0.1 to 2 kgf/cm$^2$.

The present invention provides a hot water-resistant paper and a low-basis-weight eco-friendly oil-absorbing paper manufactured using the press-heating gas grafting hydrophobization apparatus.

Since the hot water-resistant paper maintains hydrophobization even in hot water of 80 to 120° C., the paper can be used as a packaging material or container for packaging high-temperature contents containing moisture or for products exposed to high temperatures while being in contact with moisture.

The low-basis-weight eco-friendly oil-absorbing paper is a paper having a basis weight of 20 to 50 g/m$^2$ or a paper having a low density by creping treatment, which adsorbs only oil such as edible oil or waste oil.

Advantageous Effects

The present invention relates to a press-heating gas grafting hydrophobization apparatus and a hot water-resistant paper and an oil-absorbing paper manufactured by using the press-heating gas grafting hydrophobization apparatus.

In the press-heating gas grafting hydrophobization apparatus according to the present invention, since a non-air-permeable dryer belt is provided surrounding and pressing a drying roller to prevent dissipation from a base material of a fatty acid chloride vaporized by the drying roller, the press-heating gas grafting hydrophobization apparatus has an advantage of improving efficiency of a gas grafting reaction.

Therefore, by using the press-heating gas grafting hydrophobization apparatus according to the present invention, the reaction amount of fatty acid chloride per unit area can be remarkably improved.

When the press-heating gas grafting hydrophobization apparatus according to the present invention is used, since it is possible to promote the reaction of fatty acid chloride by promoting heat conduction and inducing partial melting of a barrier coating layer such as PVA, the paper can be used as a container that can package or contain foods containing hot water and the like, and thus, it is possible to obtain an effect that the paper can replace a plastic composite material in the related art that causes environmental pollution.

In addition, by using the press-heating gas grafting hydrophobization apparatus according to the present invention, even a low-basis-weight paper that has a low basis weight or is creped and cannot be subjected to hydrophobization treatment is hydrophobized, so that it is possible to manufacture a light, economical low-basis-weight eco-friendly oil-absorbing paper.

BEST MODE

Figure 1:
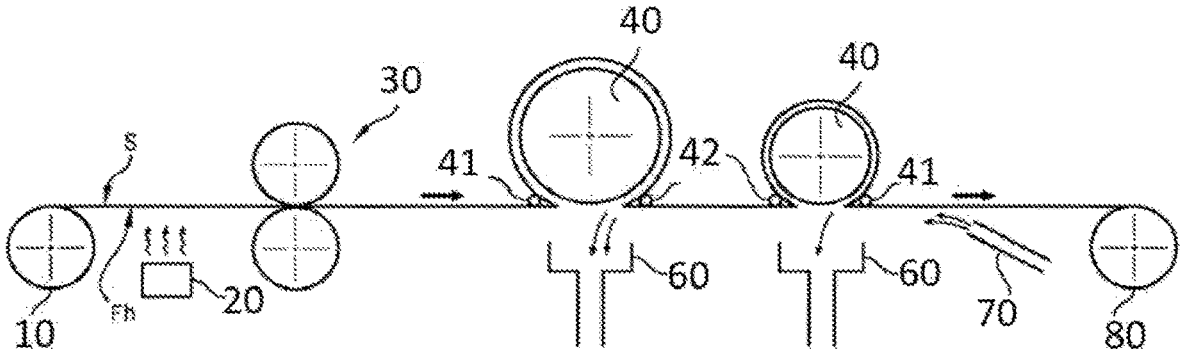
FIG. 1 illustrates a configuration diagram of a gas grafting hydrophobization apparatus in the related art.

As a best mode of carrying out the present invention, there is provided a press-heating gas grafting hydrophobization apparatus including: an unwinder unit 10 for continuously supplying a base material; a drying unit 20 for heating a surface of the base material exposed to a hydroxyl group; a coating roller 30 for coating a gas grafting reagent on the surface of the base material exposed to the hydroxyl group; a drying roller 40 for evenly vaporizing the coated grafting reagent on the surface of the base material, the drying roller guiding the surface of the base material on which the grafting reagent is coated toward a surface of the drying roller 40; an non-air-permeable dryer belt 50 located on an outer surface of the base material on which the gas grafting reagent is coated and surrounding the drying roller 40, and pressing the base material on which the gas grafting reagent is coated to the drying roller 40; a ventilator 60 for removing hydrogen chloride generated during a gas grafting reaction; an air knife nozzle 70 for removing a residual gas grafting reagent from the surface of the base material; and a rewinder unit 80 for rewinding the base material subjected to the gas grafting reaction.

DETAILED DESCRIPTION

The present invention is to provided a press-heating gas grafting hydrophobization apparatus including; an unwinder unit 10 for continuously supplying a base material; a drying unit 20 for heating a surface of the base material exposed to a hydroxyl group; a coating roller 30 for coating a gas grafting reagent on the surface of the base material exposed to the hydroxyl group; a drying roller 40 for vaporizing the coated grafting reagent and heating the grafting reagent so that a grafting reaction occurs on the surface of the base material, the drying roller including touch rolls 41 and 42 for closely contacting the surface of the base material on which the grafting reagent is coated toward a surface of the belt; a dryer belt 50 for surrounding the drying roller 40 and closely contacting (pressing) the surface of the base material on which the grafting reagent is coated toward a surface of the drying roller 50; a ventilator 60 for removing hydrogen chloride generated during a gas grafting reaction; an air knife nozzle 70 for removing a residual gas grafting reagent from the surface of the base material; and a rewinder unit 80 for rewinding the base material subjected to the gas grafting reaction.

The unwinder unit 10 is wound with the base material, and the base material is continuously supplied by unwinding the base material. The unwinder unit 1 may constitute a roller capable of winding or unwinding the base material to be supplied.

One surface Fh of the base material S supplied from the unwinder 10, which is exposed to the hydroxyl group, faces the drying unit 20 for heating the surface of the base material S exposed to the hydroxyl group. The base material is a base material containing cellulose, and preferably, may be paper or cardboard. The base material may be coated with a polymer having a hydroxyl group. The polymer having the hydroxyl group is preferably polyvinyl alcohol (PVA). When the base material is coated with the polymer having the hydroxyl group, the hydroxyl group of the base material increases, so that the hydrophobization efficiency is increased due to the gas grafting reaction. The drying unit 20 maintains a constant temperature of the base material S and the coating roller 30. The drying unit 20 may be configured with, preferably, an air-permeable contact IR (Infra Red) dryer.

The coating roller 30 coats the gas grafting reagent on the surface of the base material exposed to the hydroxyl group. The coating roller 30 may be a roller for flexography or heliography printing, and preferably, an anilox roller, that is, a gravure roller.

The gas grafting reagent contains a fatty acid chloride. The fatty acid chloride may be a fatty acid chloride in which a hydroxyl group of a saturated or unsaturated fatty acid having 6 to 22 carbon atoms is substituted with chlorine. For example, the fatty acid chloride may be any one or a mixture of two or more selected from a group consisting of a fatty acid chloride of a myristoleic acid, a palmitophosphoric acid, a sapienic acid, an oleic acid, an eladic acid, a vaccenic acid, a linoleic acid, a linoelaidic acid, an α-linolenic acid, an arachidonic acid, an eicosapentanoic acid, an erucic acid, a docosahexaenoic acid, a caprylic acid, a capric acid, a lauric acid, a myristic acid, a palmitic acid, a stearic acid, an arachidic acid, a behenic acid, a lignoceric acid, or a cerotic acid. Preferably, the fatty acid chloride is a mixture of palmitoyl chloride and stearoyl chloride, more preferably, a 1:1 mixture of palmitoyl chloride and stearoyl chloride.

The drying roller 40 evenly spreads the grafting reagent coated by the coating roller 3 on the base material S. The drying roller 40 transfers the reaction heat to the base material S, so that the gas grafting reaction occurs.

In the gas grafting reaction, a gaseous fatty acid chloride reacts with the reaction heat transferred from the drying roller 40 on a hydrophilic surface including the hydroxyl groups on the base material (S) to form fatty acid esters, so that the hydrophilic surface is hydrophobized.

The gas grafting reaction expressed in Chemical Reaction Formula 1 proceeds at a very high speed. The reaction heat transferred from the drying roller 40 has an effect of accelerating the reaction between the base material S and the vaporized fatty acid chloride. The efficiency of the chemical reaction is determined according to the degree to which the reaction heat transferred by the drying roller 40 is transferred to the base material S. In particular, if the reaction heat transferred by the drying roller 40 is not transferred to the base material S, the hydrophobization rate is lowered.

In the related art, in a gas grafting apparatus, the drying roller 40 includes the touch rolls 41 and 42 for guiding the surface of the base material on which the grafting reagent is coated toward a surface of the drying roller 40 and allowing the reaction heat of the roller 40 to be more effectively transferred to the base material (S).

However, the configuration of guiding the base material S to the drying roller 40 by using the touch rolls 41 and 42 is a method that depends on only the tension of the base material S. If the base material is guided depending on only the tension of the base material, the degree of adhering due to the guiding may differ depending on physical properties of the base material and an operating method of the device. The difference in the degree of adhering may cause a difference in the transfer of reaction heat to the base material. If the degree of transfer of the reaction heat is different, the degree of gas grafting reaction differs, which causes a difference in hydrophobization efficiency.

In addition, the guiding method that depends on only the tension of the base material S has a disadvantage in that the degree of adhering between the base material S and the drying roller 40 is weak. If the degree of adhering is weak, a gap is generated between the base material S and the drying roller 40, so that the vaporized fatty acid chloride may escape. Since the vaporized fatty acid chloride escaping at the gap does not participate in the reaction, it may be another cause of deterioration of the hydrophobization efficiency.

The escaping of the vaporized fatty acid chloride without participating in the reaction becomes a more serious problem in the case of using low-basis-weight paper having q a low density as the base material S. If the density of the base material S is low, the vaporized fatty acid chloride does not participate in the reaction and passes through the base material S, so that the vaporized fatty acid chloride easily escapes. This phenomenon cannot be solved by a method of adjusting the degree of adhering between the base material S and the drying roller 40.

In the related art, the gas grafting has been performed on the low-basis-weight base material having a low density by laminating the base material to reduce air permeability. However, the method has a problem in that the degrees of hydrophobization of the base materials constituting the respective layers are not the same. In addition, the method has a problem in that a pre-treatment process for the lamination and a process of separating the hydrophobized laminated product into single-layers are required, resulting in low production efficiency.

The invention provides a dryer belt 50 surrounding the drying roller 40 in order to solve the above-described problems.

The dryer belt 50 is non-air-permeable. Therefore, even though the vaporized fatty acid chloride passes through the base material S, the vaporized fatty acid chloride does not pass through the dryer belt 50 and thus, remains on the surface of the drying roller 40 and inside the base material.

In addition, the dryer belt 50 presses the base material S to the surface of the drying roller 40 at a pressure of 0.1 to 2 $kgf/cm^2$.

The dryer belt 50 surrounds a plurality of dryer belt touch rolls 51 disposed in the periphery of the drying roller 40 and surrounds the drying roller 40 at a pressure of 0.1 to 2 $kgf/cm^2$.

The dryer belt 50 rotates at the same speed and direction as the drying roller 40. The base material S passing through the coating roller 30 enters between the drying roller 40 and the dryer belt 50, and the dryer belt 50 presses the base material S to the surface of the drying roller 40 at a pressure of 0.1 to 2 kgf/cm$^2$.

The reaction heat of the drying roller 40 is directly transferred to the pressed base material S without any loss of the reaction heat of the drying roller 40.

In addition, since the fatty acid chloride vaporized by the reaction heat is prevented from being dissipated by the dryer belt 50 and remains in the base material S, the efficiency of the gas grafting reaction rapidly increases.

In an embodiment of the present invention, the reaction amounts per unit area of the fatty acid chlorides of the base materials, which are hydrophobized by using the gas grafting apparatus in the related art without the dryer belt 50 and the gas grafting apparatus according to the present invention provided with the dryer belt 50, are measured and compared. As a result, it has been confirmed that the reaction amount of the fatty acid chloride in the case of the base material S manufactured using the gas grafting apparatus according to the present invention is improved by six times as compared with that in the case of the base material S manufactured using the gas grafting apparatus in the related art.

When the pressure of the dryer belt 50 is less than 0.1 kgf/cm$^2$, dissipation of the vaporized fatty acid chloride cannot be suppressed; and when the pressure of the dryer belt 50 exceeds 2 kgf/cm$^2$, the drying roller 40 and the base material S entering the dryer belt 50 may be damaged. Preferably, the pressure of the dryer belt 50 is 0.3 to 1 kgf/cm$^2$, and more preferably, the pressure of the dryer belt 50 is 0.5 kgf/cm$^2$.

Korean Patent Application Publication No. 10-2016-0141920 discloses a gas grafting hydrophobization apparatus is described in which a belt is provided to facilitate the discharge of hydrogen chloride remaining after the gas grafting reaction of fatty acid chloride. The dryer belt 50 of the present invention can also be coated to a gas grafting hydrophobization apparatus in which the belt is provided, so that the hydrophobization efficiency of the base material S can be improved.

In Korean Patent Application Publication No. 10-2016-0141920, the belt is provided on the drying roller and has only a function of facilitating the discharging of hydrogen chloride. Therefore, when the dryer belt 50 of the present invention is provided to surround the belt of Korean Patent Application Publication No. 10-2016-0141920 with a pressure of 0.1 to 2 kgf/cm$^2$, the hydrophobization efficiency can be improved.

The hydrogen chloride remaining after the reaction, on the base material S hydrophobized by the gas grafting reaction while passing through the drying roller 40 and the dryer belt 50, is removed by the ventilation fan 60 on the base material S. The base material passing through the ventilator 60 passes through the air knife nozzle 70. The air knife nozzle 8 sprays hot air to wash and remove the unreacted gas grafting reagent, for example, a fatty acid chloride, a fatty acid, or the like, remaining on the base material S.

Finally, the hydrophobized base material S is wound up in a roll state by the rewinder unit 80 again.

The present invention provides hot water-resistant paper has a basis weight of 60 to 80 g/cm$^2$ and maintains hydrophobization even in hot water of 80 to 120° C. by performing press-heating gas grafting hydrophobization treatment on the base material coated with polyvinyl alcohol.

The hot water-resistant paper denotes paper that maintains a hydrophobic state in hot water of 80 to 120° C. The hydrophobic state can be determined by measuring the size of Cobb.

When the size of Cobb is less than 10 g/m$^2$, the sufficient hydrophobization can be maintained, and the paper can be used as a container containing water or the like.

The hot water-resistant paper according to the present invention is characterized in that the size of $Cobb_{1800}$ is 6 to 8 g/m$^2$ in hot water of 80 to 120° C. Preferably, the hot water-resistant paper according to the present invention is characterized in that the size of $Cobb_{1800}$ is 7 g/m$^2$ in hot water of 100° C.

The size of $Cobb_{1800}$ denotes the result of testing the degree of water absorption in water for 1800 seconds. If the size of $Cobb_{1800}$ is about 8 g/m$^2$ in the hot water of 80 to 120° C., the hydrophobic state is maintained in the hot water of 80 to 120° C. and can be used as a container for hot food or water, and thus, there is no need to further reduce the size of $Cobb_{1800}$ in hot water of 80 to 120° C. through excessive hydrophobization.

The hydrophobization is determined by the degree of alkylation or alkenylation formed in the hydroxyl group of the base material by the chemical reaction, and thus, the hydrophobization can be determined by measuring the concentration per unit area of the fatty acid chloride present in the base material after the gas grafting reaction.

The hot water-resistant paper according to the present invention is characterized in that the density of the fatty acid chloride is 1100 to 1300 m g/m$^2$. Preferably, the hot water-resistant paper according to the present invention is characterized in that the density of the fatty acid chloride is 1200 m g/m$^2$. If the density of the fatty acid chloride is less than 1100 m g/m$^2$, the paper is inappropriate for manufacturing as a container containing hot food or water. In addition, even if the density of the fatty acid chloride exceeds 1300 m g/m$^2$, the degree of improvement of the ability to contain hot food or water is insignificant.

The press-heating gas grafting hydrophobization treatment is performed by the press-heating gas grafting hydrophobization apparatus described above.

The press-heating gas grafting hydrophobization apparatus has an effect of improving the efficiency of the gas grafting reaction due to including the non-air-permeable dryer belt 50.

Since the configuration of the press-heating gas grafting hydrophobization apparatus has been described in detail above, in order to avoid duplication of the specification, the configuration will not be described.

According to an embodiment of the present invention, the reaction amount per unit area of the fatty acid chloride in the base material hydrophobized by using the press-heating gas grafting hydrophobization apparatus is six times larger than that in the based material hydrophobized by using the gas grafting hydrophobization apparatus in the related art.

The hot water-resistant paper according to the present invention has a basis weight of 60 to 80 g/cm$^2$, and a base material coated with polyvinyl alcohol is used.

In the case of imparting waterproof and moisture-proof properties to the base material by the gas grafting of the fatty acid chloride, the hydrophobization efficiency can be further improved by coating PVA (polyvinyl alcohol) on the base material. The PVA is a biodegradable polymer compound having more hydroxyl groups than cellulose of paper.

According to an embodiment of the present invention, when the amount of the fatty acid chloride coated for gas grafting reaction on the PVA-coated paper is 0.1 to 2 g/m$^2$, it is confirmed that, if the gas grafting hydrophobization apparatus in the related art is used, the content of the fatty acid chloride per unit area is 200 to 300 m g/m$^2$, and after 30 minutes elapse in clean water, the size of Cobb is 7 to 9 g/m$^2$. This means that if the PVA-coated paper is hydrophobized with the fatty acid chloride, it is possible to sufficiently replace the PE laminating treatment method, which is a hydrophobization treatment method in the related art.

However, when hot water of around 100° C. is used for the PVA-coated hydrophobized paper instead of fresh water, the size of Cobb is measured after 30 minutes, and the size of Cobb is confirmed to be 20 to 30 g/m$^2$ or more. Therefore, it is confirmed that the material cannot replace the PE laminating-treated composite material, which is a plastic composite material in the related art.

On the contrary, it is confirmed that the hot water-resistant paper hydrophobized by using the press-heating gas grafting hydrophobization apparatus according to the present invention under the same conditions as above maintained the size of $Cobb_{1800}$ of hot water of 80 to 120° C. at 6 to 8 g/m$^2$.

It is confirmed that the size of $Cobb_{1800}$ of the hot water-resistant paper is a level that can be used as a container maintaining the functionality to resist water even when the paper packaged high temperature contents containing moisture or the paper is exposed to high temperature in a state where the paper is heated in contact with moisture while replacing the PE-laminated composite material in the related art.

The present invention provides a low-basis-weight eco-friendly oil-absorbing paper of 20 to 50 g/m$^2$ manufactured by a press-heating gas grafting hydrophobization method by for a one-ply low-basis-weight paper having a basis weight of 20 to 50 g/m$^2$.

The press-heating gas grafting hydrophobization treatment is performed by the press-heating gas grafting hydrophobization apparatus described above.

The press-heating gas grafting hydrophobization apparatus includes the non-air-permeable dryer belt 50, and thus, has an effect of improving the efficiency of the gas grafting reaction The configuration of the press-heating gas grafting hydrophobization apparatus has been described in detail above, in order to avoid duplication of the specification, the configuration will not be described.

The eco-friendly oil-absorbing paper denotes paper that absorbs only oil without absorbing water. The eco-friendly oil-absorbing paper is used for kitchen to remove excessive oil from fried foods, waste oil left after use, oil spilled into the sea or river, and the like.

General kitchen paper towels get wet easily due to water vapor discharged from foods. Therefore, the kitchen paper towel has difficulty in absorbing oil.

However, the low-basis-weight eco-friendly oil-absorbing paper according to the present invention has an advantage of absorbing only oil without getting wet with water due to hydrophobicity of the oil-absorbing paper, so that the oil-absorbing paper is effective in removing oil used in fried foods or the like.

The oil-absorbing material used to remove oil spilled into the sea and river absorbs oil and water at the same time, and thus, the oil-absorbing material easily sinks into the sea or river. If the oil-absorbing material used to remove oil sinks into the sea or river, the oil-absorbing material cannot be recovered. The sinking oil-absorbing material has a problem of causing secondary pollution of the sea and river.

The low-basis-weight eco-friendly oil-absorbing paper according to the present invention easily floats in water due to a low density and absorbs only oil without absorbing water, so that the paper has an advantage of removing oil but not sinking into the sea or water. Therefore, since the low-basis-weight eco-friendly oil-absorbing paper according to the present invention can be properly disposed of after adsorbing the spilled oil, there is no concern about secondary pollution of the sea or river.

Since the paper has a low basis weight of less than 50 g/m$^2$ and a low retention rate and is wrinkled by creping treatment is light and inexpensive, the paper is widely used. But, because of such a low retention rate, the paper has a problem in that hydrophobization using a method in the related art cannot be difficult to achieve. In addition, with respect to the low-basis-weight paper, it is difficult to use the method of adding an internal additive size agent in the related art, and since the creping-treated paper has wrinkles, the water-repellent treatment (hydrophobization treatment) using a post-processing such as a blade or roll coater is impossible.

Theoretically, in gas grafting hydrophobization treatment using a fatty acid chloride of the present invention, since the gas grafting hydrophobization treatment using the fatty acid chloride is a post-processing process not a paper-making process, and since a vaporized fatty acid chloride reacts with hydroxyl groups of the paper, there is an advantage in that hydrophobization is available regardless of a low-basis-weight paper or existence of wrinkles due to creping treatment.

However, actually, the gas grafting hydrophobization treatment using the fatty acid chloride on the low-basis-weight paper is limited. The reason is that, due to the characteristics of the low-basis-weight paper, the vaporized fatty acid chloride does not remain on the base material (paper) and is easily dissipated, and thus, efficiency of hydrophobization reaction is very low.

In the related art, the only solution is to perform the gas grafting hydrophobization treatment using the fatty acid chloride after laminating the low-basis-weight paper and adjusting the air permeability. However, in the laminating method, a multi-layered laminated paper is formed by combining the base materials, and after the hydrophobization, the laminated paper is separated t into individual base materials. The laminating method has a problem that the degree of hydrophobization of the base materials separated after the hydrophobization treatment is also not uniform.

The present invention solves the above-described problems by using the press-heating gas grafting hydrophobization method.

The press-heating gas grafting hydrophobization method according to the present invention is performed by using the press-heating gas grafting hydrophobization apparatus including the dryer belt 50 surrounding the drying roller 40 to press the base material to the surface of the drying roller 40.

The dryer belt 50 is non-air-permeable and allows the surface of the base material on which the grafting reagent is coated is adhered toward the surface of the drying roller.

Therefore, even if the fatty acid chloride vaporized by the drying roller 40 passes through the base material having a low-basis-weight, the fatty acid chloride remains on the base material due to the dryer belt, so that an effective gas grafting hydrophobization treatment using fatty acid chloride is possible.

In addition, since the dryer belt 50 applies pressure to adhere the low-basis-weight base material on the surface of the drying roller 40, the reaction heat of the drying roller 40 is directly transferred, so that it I possible to obtain an effect of remarkably improving the efficiency of hydrophobization reaction.

The configuration of the press-heating gas grafting hydrophobization apparatus has been described in detail above, in order to avoid duplication of the specification, the configuration will not be described.

According to an embodiment of the present invention, when a one-ply low-basis-weight paper having a basis weight of 20 to 50 g/m$^2$ is hydrophobized by the press-heating gas grafting hydrophobization apparatus, it is possible to manufacture a low-basis-weight eco-friendly oil-absorbing paper having a density of the fatty acid chloride of 100 to 300 m g/m$^2$ and a degree of absorption of 0.2 to 0.4 g/m$^2$ in cold water at 4 to 10° C.

Through the following examples, the present invention will be described in more detail.

EXAMPLE

Example 1: Manufacturing PVA-Coated Hot Water-Resistant Paper Using Press-Heating Gas Grafting Apparatus After the PVA is coated on the base stock of white release paper having a basis weight of 70 g/m$^2$, a PVA-coated hot water-resistant paper is manufactured by using the press-heating gas grafting hydrophobization apparatus for the fatty acid chloride.

Figure 2:
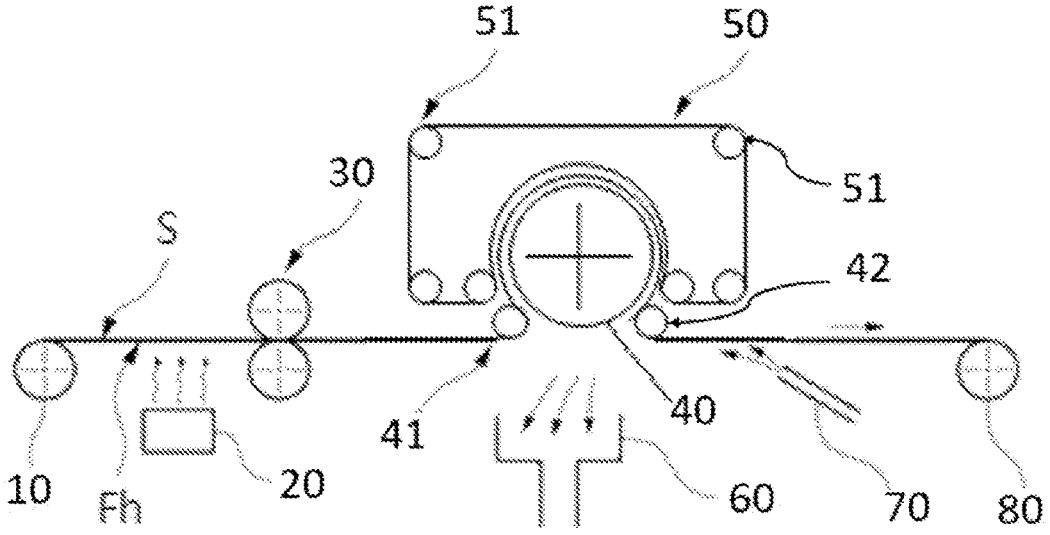
FIG. 2 illustrates a configuration diagram of a press-heating gas grafting hydrophobization apparatus according to the present invention.

FIG. 2 illustrates the structure of a press-heating gas grafting hydrophobization apparatus for the fatty acid chloride, provided in a T company that is a release paper manufacturer located in Dongducheon, Gyeonggi-do.

In the press-heating gas grafting apparatus, the dryer belt 10 which adheres the paper toward the dryer at a pressure of 0.5 kgf/cm$^2$ is applied so that the paper to be subjected to the hydrophobization treatment is adhered to the surface of the dryer.

First, PVA coating is performed to the white release base paper having a basis weight of 70 g/m$^2$, and a picked-up amount is adjusted to 8 g/m$^2$. As for the fatty acid chloride, a product in which palmitoyl chloride (C16) and stearoyl chloride (C18) are mixed at 5:5 is used. The fatty acid chloride is coated on the PVA-coated white release base paper by an anilox roller with a coating amount of 1.3 g/m$^2$. The temperature of the anilox, that is, the gravure roller, is fixed at 60° C., and the temperature of the drying roller is adjusted to 200° C. The temperature of hot air for air knife flushing is set to 300° C. Under the above-described treatment conditions, the operating speed of the apparatus is fixed at 50 m/min, and the hydrophobization treatment is performed.

For the hydrophobized PVA-coated paper, after 1800 seconds elapsed in boiling water, the size of Cobb is measured. Next, the gas chromatography analysis is performed on the hydrophobized PVA-coated paper to measure the density (m g/m$^2$) of the reacted fatty acid chloride.

Comparative Example 1: Manufacturing of PVA-Coated Hot Water-Resistant Paper Using Gas Grafting Apparatus in the Related Art PVA coated hot water-resistant paper is manufactured by using a gas grafting apparatus in the related art.

FIG. 1 illustrates the structure of the gas grafting apparatus in the related art, provided in a T company that is a release paper manufacturer located in Dongducheon, Gyeonggi-do.

Similarly to Example 1, PVA coating is coated to the white release base paper having a basis weight of 70 g/m$^2$, and a picked-up amount is adjusted to 8 g/m$^2$. As for the fatty acid chloride, a product in which palmitoyl chloride (C16) and stearoyl chloride (C18) are mixed at 5:5 is used, and the product is coated by a coated amount of 1.3 g/m$^2$ by using the anilox roller once, so that a total of 1.3 g/m$^2$ is coated. The temperature of the anilox roller, that is, the gravure roller, is fixed at 60° C. The temperature of the two drying rollers is adjusted to 200° C., and the temperature of hot air for air knife flushing is adjusted to 300° C. Under the above-described treatment conditions, the operating speed of the apparatus is fixed at 50 m/min, and hydrophobization treatment is performed.

For the hydrophobized PVA coated paper, after 1800 seconds elapsed in boiling water, the size of Cobb is measured. Next, for the PVA coated hot water-resistant paper manufactured through the Example, after 1800 seconds elapsed in boiling water, the size of Cobb is measured. Then, the two sizes of Cobb are compared.

The gas chromatography analysis is performed on the hydrophobized PVA-coated paper to measure the density (m g/m$^2$) of the reacted fatty acid chloride. This density is compared with the density (m g/m$^2$) of the fatty acid chloride reacted in the PVA-coated hot water-resistant paper manufactured through the Example.

Table 1 below lists the comparison results of the size of Cobb and the densities of the reacted fatty acid chloride of the PVA-coated hot water-resistant papers manufactured through Example 1 and Comparative Example 1.

Example 2: Manufacturing of Low-Basis-Weight Eco-Friendly Oil-Absorbing Paper by Using Press-Heating Gas Grafting Apparatus A low-basis-weight eco-friendly oil-absorbing paper is manufactured from a low-basis-weight, low-density (40 g/m$^2$) paper by using a press-heating gas grafting apparatus for a fatty acid chloride.

The low-basis-weight eco-friendly oil-absorbing paper is manufactured by using a press-heating gas grafting apparatus provided in T company, that is a release paper manufacturer located in Dongducheon, Gyeonggi-do, which is the same as in Example 1.

First, a fatty acid chloride product in which palmitoyl chloride (C16) and stearoyl chloride (C18) are mixed in a ratio of 5:5 is coated on a one-ply paper towel having a basis weight of 40 g/m$^2$ by a coating amount of 1.3 g/m$^2$ by using an anilox roller. The temperature of the anilox roller, that is, the gravure roller, is fixed at 60° C., the temperature of the drying roller is adjusted to 200° C., and the temperature of hot air for air knife flushing is 300° C.

Under the above-described treatment conditions, the operating speed of the apparatus is fixed at 50 m/min, and the hydrophobization treatment is performed. After that, the amount of cold water absorption for the treated paper towel is measured according to the test method of the oil-absorbing material.

Comparative Example 2: Manufacturing of Low-Basis-Weight Eco-Friendly Oil-Adsorbing Paper Using Gas Grafting Apparatus in the Related Art a hot water-resistant paper is manufactured by using the same low-basis-weight, low density (40 g/m$^2$) paper as in Example 2 and the same gas grafting apparatus (refer to FIG. 1) of the related art as in Comparative Example 1.

A fatty acid chloride in which palmitoyl chloride (C16) and stearoyl chloride (C18) are mixed at a ratio of 5:5 is coated on a five-ply paper towel having a basis weight of 40 g/m$^2$ by a coated amount of 1.3 g/m$^2$ by using the anilox roller once, so that a total of 1.3 g/m$^2$ is coated. The temperature of the anilox roller, that is, the gravure roller, is fixed at 60° C., the temperature of the two drying rollers is adjusted to 200° C., and the temperature of hot air for air knife flushing is adjusted to 300° C.

After fixing the operating speed of the apparatus at 50 m/min under the above-described treatment conditions, hydrophobization treatment is performed to manufacture the hot water-resistant paper.

Similarly to Example 2, for the manufactured hot water-resistant paper, the amount of cold water absorption is measured according to the test method of an oil-absorbing material, and the result is compared with the result of Example 2.

Table 2 below lists the results of measurement of an amount of cold water absorption for the hot water-resistant paper of Example 2 and Comparative Example 2 based on the test method of the oil-absorbing material.

Experimental Example: Evaluation of Amount of Water Absorption and Fatty Acid Chloride Reaction With respect to the hot water-resistant papers manufactured in Examples and Comparative Examples, the sizes of Cobb for boiling water and cold water are evaluated, the degree of water absorption is evaluated, and gas chromatography is performed to evaluate the degree of fatty acid chloride reaction.

In Example 1 and Comparative Example 1, the degrees (cobb size) of boiling water absorption are evaluated, the degree of fatty acid chloride reaction is measured, and the degree of reactivity improvement by the dryer belt 10 which adheres the paper toward the dryer is evaluated.

In Example 2 and Comparative Example 2, the respective degrees of cold water absorption are evaluated.

Table 1 below lists the sizes of Cobb and the degrees of reaction of fatty acid chloride to boiling water of Example 1 and Comparative Example 1, and Table 2 below lists the degrees of cold water absorption of Example 2 and Comparative Example.

TABLE 1

| | Basis Weight | Cobb 1800s_Hot Water (g/m$^2$) | Reacted Fatty Acid Chloride Content (mg/m$^2$) |
|---|---|---|---|
| Example 1 | 70 g/m$^2$ | 7.1 | 1200 |
| Comparative Example 1 | 70 g/m$^2$ | 35.2 | 200 |

TABLE 2

| | Basis Weight | Number of Plys | Cold Water Absorption (g/m$^2$) |
|---|---|---|---|
| Example 2 | 40 g/m$^2$ | 1 ply | 0.30 |
| Comparative Example 2 | 40 g/m$^2$ | 5 plys | 0.35 |

According to Table 1, compared with Comparative Example 1, it is confirmed that the size of Cobb of the PVA coated paper of Example 1 using the dryer belt 10 of the present invention is much better.

The dryer belt 50 of the present invention does not allow air to pass. In addition, in the dryer belt 10 of the present invention, when the surface of the PVA coated paper is to be hydrophobized by gas-grafting for the fatty acid chloride, the dryer belt adheres the paper toward the dryer at a pressure of 0.5 kgf/cm$^2$, so that the paper is adhered on the surface of the dryer. Therefore, since the fatty acid chloride passes by the dryer belt of the present invention and participates in the reaction without disappearing, the reaction amount per unit area of the fatty acid chloride is increased by more than 6 times from 200 m g/m$^2$ to 1200 m g/m$^2$, and the degree of absorption for $Cobb_{1800}$ of boiling water is also reduced from 35.2 g/m$^2$ to 7.1 g/m$^2$.

According to Table 2, it is confirmed that the water resistance of the oil-absorbing paper of Example 2 using the dryer belt 50 of the present invention is similar to that of Comparative Example 2. The oil-absorbing paper of Example 2 and the oil-absorbing paper of Comparative Example 2 are low-basis-weight (40 g/m$^2$) papers and are different in that Example 2 is a one-ply paper, and Comparative Example 2 uses a five-ply paper.

In the case of a low-basis-weight (40 g/m$^2$) paper, during the gas grafting, the vaporized fatty acid chloride easily passes through the paper due to the low density of the paper, so that the efficiency of grafting is very low, and it is difficult to perform hydrophobization using the gas grafting. This is the same even in the case of the paper of which density is lowered by creping treatment.

In the present invention, the dryer belt 50 that does not pass through air is devised, and the dryer belt is applied in a state where the dryer belt is adhered to the paper at a pressure of 0.5 kgf/cm$^2$, so that during the gas grafting of a paper having a low-basis-weight (40 g/m$^2$) or a low density due to the creping treatment, the fatty acid chloride does not easily pass through the paper. As a result, it has been confirmed that the reaction of the fatty acid chloride increased, and even paper having a low-basis-weight or creped exhibited a hydrophobization efficiency similar to that of the paper in the related art.

According to Table 2, in the press-heating gas grafting apparatus according to the present invention, it is confirmed that the amount of absorption for the paper of Example 2 which is obtained by forming a one-ply paper having a low-basis-weight (40 g/m$^2$) and, after that, performing the gas grafting is smaller than that of the paper of Comparative Example 2 which is obtained by forming a five-ply paper having a low-basis-weight (40 g/m$^2$) and, after that, performing the gas grafting.

This means that the dryer belt 50 of the present invention has improved reactivity by confining the fatty acid chloride.

The PE-laminated paper in the related art has a size of Cobb of 10 g/m$^2$ and is not wetted by moisture, so that the paper can be used as a food container. This is the effect of plastic PE, the same effect is exhibited in boiling water, and the paper is used as a container containing hot foods, and the like According to Table 1, when paper is hydrophobized by using a gas grafting apparatus in the related art, the size of Cobb using hot water (boiling water) is 35.2 g/m$^2$ (Comparative Example 1), it is confirmed that the paper cannot be used a container for containing water.

On the other hand, when the press-heating gas grafting apparatus to which the dryer belt 50 of the present invention is applied is used, the content of salt fatty acid is greatly increased to 1200 m g/m$^2$, and the size of Cobb in hot water (boiling water) is also maintained at 7.1 g/m$^2$, so that it is confirmed that the paper can be used as a container for containing water.

In particular, since the size of Cobb in hot water (boiling water) is maintained at 7.1 g/m$^2$, when a paper is hydrophobized by using the press-heating gas grafting apparatus to which the dryer belt of the present invention is applied, it is considered that, instead of a PE-laminated paper composite material in the related art, the paper can be applied as an eco-friendly paper container that packages high temperature contents containing water or does not get wet even if the paper is heated in contact with other moisture and is exposed to high temperature.

The specific embodiments described in this specification are intended to represent preferred embodiments or examples of the present invention, and the scope of the present invention is not limited. It is apparent to those skilled in the art that modifications and various uses of the present invention do not depart from the scope of the present invention disclosed in the claims of this specification.

INDUSTRIAL AVAILABILITY

The press-heating gas grafting hydrophobization apparatus according to the present invention and the hot water-resistant paper and oil-absorbing paper manufactured by using the press-heating gas grafting hydrophobization apparatus can be used in the field of manufacturing a hydrophobic paper that can replace disposable hydrophobic plastic and can be used for removing oil pollution by absorbing only oil not water.

What is claimed is:

1. A press-heating gas grafting hydrophobization apparatus comprising:

an unwinder unit for continuously supplying a base material;

a drying unit for heating a surface of the base material exposed to a hydroxyl group;

a coating roller for coating a gas grafting reagent on the surface of the base material exposed to the hydroxyl group;

a drying roller for evenly spreading the coated grafting reagent on the surface of the base material, the drying roller guiding the surface of the base material on which the grafting reagent is coated toward a surface of the drying roller;

a non-air-permeable dryer belt located on an outer surface of the base material on which the gas grafting reagent is coated and surrounding the drying roller, and pressing the base material on which the gas grafting reagent is coated to the drying roller;

a ventilator for removing hydrogen chloride generated during a gas grafting reaction;

an air knife nozzle for removing a residual gas grafting reagent from the surface of the base material; and a rewinder unit for rewinding the base material subjected to the gas grafting reaction.

2. The press-heating gas grafting hydrophobization apparatus according to claim 1, wherein the dryer belt prevents dissipation of the vaporized grafting reagent.

3. The press-heating gas grafting hydrophobization apparatus according to claim 1, wherein the dryer belt presses the base material on which the gas grafting reagent is coated to the surface of the drying roller at a pressure of 0.1 to 2 kgf/cm$^2$.

* * * * *